US006269971B1

(12) United States Patent
Nystrom et al.

(10) Patent No.: US 6,269,971 B1
(45) Date of Patent: Aug. 7, 2001

(54) METHOD AND APPARATUS FOR DOSING A MEDICAL PREPARATION

(75) Inventors: Christer Nystrom, Uppsala; Sten-Magnus Aquilonius, Sigtuna, both of (SE)

(73) Assignee: Sensidos AB, Uppsala (SE)

( * ) Notice: Subject to any disclaimer, the term of this patent is extended or adjusted under 35 U.S.C. 154(b) by 0 days.

(21) Appl. No.: 09/402,827

(22) PCT Filed: Oct. 6, 1998

(86) PCT No.: PCT/SE98/01800

§ 371 Date: Nov. 29, 1999

§ 102(e) Date: Nov. 29, 1999

(87) PCT Pub. No.: WO99/23014

PCT Pub. Date: May 14, 1999

(30) Foreign Application Priority Data

Nov. 4, 1997 (SE) ..... 9704024

(51) Int. Cl.[7] ..... G07F 11/00
(52) U.S. Cl. ..... 221/13; 221/266
(58) Field of Search ..... 221/2, 7, 13, 9, 221/82, 258, 266, 265, 277

(56) References Cited

U.S. PATENT DOCUMENTS

| | | | | |
|---|---|---|---|---|
| 3,823,844 | | 7/1974 | Linkemer et al. . | |
| 5,042,685 | | 8/1991 | Moulding, Jr. et al. . | |
| 5,337,919 | * | 8/1994 | Spaudling et al. | 221/13 |
| 5,860,563 | * | 1/1999 | Guerra et al. | 321/266 |

FOREIGN PATENT DOCUMENTS

| | | |
|---|---|---|
| 0 246 048 | 11/1987 | (EP) . |
| 0 719 537 | 7/1996 | (EP) . |

* cited by examiner

*Primary Examiner*—Kenneth W. Noland
(74) *Attorney, Agent, or Firm*—Young & Thompson

(57) ABSTRACT

A medicine is supplied in the form of a number of small units, partial doses, containing a determined, equal quantity of the active medical substance, and a number of these units, which correspond to a predetermined dose quantity, total dose, of the active medical substance are taken out and dispensed to the consumer. A device for the carrying out of the procedure comprises devices for counting and feeding-out of a number of units, partial doses of the medicine, which correspond to a predetermined dose quantity of the active medical substance and for transport of these units to a dispensing device for dispensing of the above-mentioned dose quantity, total dose, to a consumer.

13 Claims, 1 Drawing Sheet

METHOD AND APPARATUS FOR DOSING A MEDICAL PREPARATION

The present invention has general reference to a procedure and a device for dosing of a medicine. More exactly, the invention has reference to a procedure and a device for the taking out of a quantity of medicine from a storage of the medicine; a quantity that corresponds to a predetermined dose (total dose) of the active medical substance and for dispensing this quantity to a consumer.

BACKGROUND OF THE INVENTION

In connection with administration of medicines ready for use two main groups of dosage forms or preparations can be identified. The largest group consists of medicines, known as dosed medicines. Examples of such preparations are tablets, capsules, injection ampoules and others, where each preparation unit contains a predetermined dose of the active medical substance. It can be said that one of the great advantages of this form of preparation is that the dosing of the medicine is built into the dosage form. Naturally, this puts high demands on what concerns the highest variation permitted of medicine content in the separate preparation units.

The other group of medicines consists of non-dosed medicines. Dosage forms as ointments, mixtures, powders, granulates, large volume parenterals and others belong to this group. From such dosage forms the quantity corresponding to the dose required in a specific case is taken out on each occasion of medicine administration. The reason why non-dosed forms are used is that in many cases the exact dose quantity of active medical substance required for administration to the patient can not be predicted.

The limit between dosed and non-dosed medicines is not clearly defined. Thus, packages of single doses of non-dosed medicine can be found.

A frequent problem with administration of a medicine is that the dose quantity required for administration to a certain patient is known, but the choice of doses, in the form of tablets or capsules for example, is relatively limited. Frequently, a tablet has to be broken in order to divide the original dose into halves or even into quarters. Despite this dividing up of the dose, uncertainty may still remain with regard to dose accuracy, i.e. the smallest possible effective dose. This problem is not limited to solid, essentially water-free preparations solely, but there is also an obvious need for exact adjustment of a medicine dose in a dissolved or dispersed form.

Through the present invention, this inconvenience is now eliminated to a large extent.

GENERAL DESCRIPTION OF THE INVENTION

The invention is based on a new principle for the dosing of a medicine. In accordance with the invention, a procedure for dosing of a medicine is characterised in that a medicine is supplied in the form of equally large units or portions or partial doses, each of which contains a determined quantity of active medical substance and in that a number of such units, which taken together correspond to a predetermined dose quantity or total dose of the active medical substance are taken out from a storage of the medicine, whereupon these units collectively are dispensed to a consumer.

Preferably, the units are transported from the storage and fed out for dispensing in an essentially continuous movement and the transport is discontinued when the determined number of units have been dispensed. In a preferred embodiment of the invention, the units are transferred from the storage to spaces each of which contains one unit, whereupon the spaces are moved to dispensing of the units and the movement is discontinued when a predetermined number of the units have been transferred to the spaces and moved to the dispensing.

Furthermore, the invention relates to a device for dosing and dispensing of medicine, characterised in that it includes a) a storage container for a medicine;

b) a device for the feeding out of the medicine in the form of equally large units (partial doses) from the storage container and transport of the units to a dispensing device;

c) a device for counting the number of fed out units and for the discontinuance of the feeding-out, when a number of units that corresponds to a predetermined, adjustable dose quantity (total dose) of the medicine has been fed out. Preferably, the device for feeding-out and transport of the medicine units comprises a sequence of individual spaces, into which gradually one unit of a medicine is placed, which thereafter is transported to the dispensing device.

DESCRIPTION OF THE DRAWING

The accompanying drawing.

DETAILED DESCRIPTION OF THE INVENTION

Figure 3:
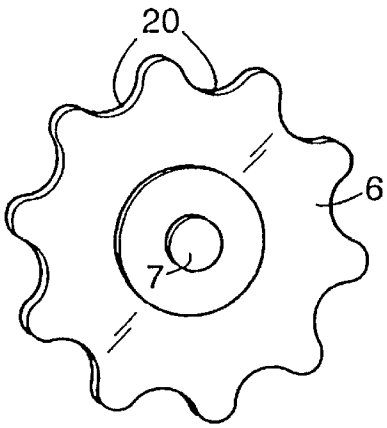
FIG. 3 shows in detail a dosing disc for use in the device.

Previously, at the dosing of a medicine in a non-dosed form, the usual procedure has been to weigh out the quantity of the active medical substance which corresponds to the dose to be given to the patient, whereupon this weighed dose quantity has been dispensed to the patient. The alternative has been to measure out a volume of the active medical substance which corresponds to the dose required and then to dispense this dose volume to the patient. When the patient on different occasions or when different patients after one another require different doses, this has caused difficulties in the weighing out or the measuring out of the different dose quantities and a high risk of mistakes and confusion has arisen.

In accordance with the present invention, at first the medicine is divided into a number of units or portions or partial doses, each of which contains a determined and equal quantity of the active medical substance. Then the required dose quantity or total dose is formed by putting together the determined number of the units, which correspond to the quantity in weight of medicine required for the dose in question, and is thereafter dispensed. Thus, in this case it is the number of units that determine the quantity of the dose and not a measured weight or volume quantity. Since all units contain the same, determined quantity of the active medical substance, the number of units required for a determined dose is easy to establish. Due to the fact that the units (partial doses) contain only a small quantity of medicine, several units are consequently required to obtain the total therapeutic dose. Precisely this fact of the matter actually constitutes the basis of a possible fine adjustment of the total dose in small steps. With the aid of a feeding-out device controlled by a counter, the required number of units can easily be taken out from storage and led to a dispensing device. When varying dose quantities are to be dispensed, it is easier to readjust the counter than to readjust a device for weighing or measuring.

In addition, the counting and the dispensing of the units can be performed under more hygienic and safer conditions in accordance with the invention. When weighing or measuring out a certain weight or volume quantity of a bulk substance in a powder form, there is always a risk of contamination, spillage and dust formation. This risk is completely eliminated by the procedure and the device in accordance with the present invention, where an essentially closed system can be used.

The small tablets that constitute the preferred embodiment could also be named "microtablets" and can be produced, in conformity with conventional tablets, through methods well known to the person skilled in the art. The units, however, can also, besides tablets, consist of other solid and essentially water-free, smaller units such as particles or pellets, which should be of a size within the interval of 1–8 mm, then preferably within the interval of approx. 1–4 mm. Such particles or pellets may consist of millimeter-sized granulated grains, produced for example by coating of inert sugar pellets or by extrusion/sphereonization. Irrespective of the size chosen for the portions or the units, however, a narrow distribution in size should always be aimed at.

The small tablets that constitute the preferred embodiment could also be named "microtablets" and can be produced, in conformity with conventional tablets, through methods well known to the person skilled in the art. The units, however, can also, besides tablets, consist of other solid and essentially water-free, smaller units such as particles or pellets, which preferably should be of a size within the interval of approx. 1–4 mm. Such particles or pellets may consist of millimetre-sized granulated grains, produced for example by coating of inert sugar pellets or by extrusion/sphereonization. Irrespective of the size chosen for the portions or the units, however, a narrow distribution in size should always be aimed at.

Thus, by the use of tablets or pellets, which contain a constant quantity of active medical substance, the exact total dose to be administered on a certain occasion can be adjusted through variation of the number of medicine units, such as microtablets or pellets. If, for example, a microtablet contains an average of 5 mg of active medical substance, to administer a total dose of 100 mg, consequently 20 microtablets are required. At the same time the dose can be varied in intervals of 5 mg.

Generally, each of the medicine units contains from approximately 20% to approximately 2% of the weight of the total dose to be administered and dispensed. Accordingly, this implies that a total dose consists of approximately 5–50 partial doses. However, these values are not crucial to the invention but also values outside the interval stated above are possible. Nevertheless, it should be observed that the advantages of the invention involving the fine-tuning of the dispensed total dose will no longer be utilised to the same extent, if the partial doses each contain a substantial share of the total dose. On the other hand, if the partial doses each contain a very small share of the total dose, it may be troublesome to handle the great number of partial doses required to form a total dose.

The procedure and the device in accordance with the invention are not limited to any specific type of active medical substance, but can be used for any substance that can be composed in the form of solid portions or units. Medicines in a solid state are of particular interest here, but also medicines in a liquid state in the form of solutions, emulsions and suspensions can be used. The medicines in a liquid state may then be composed as units in the form of capsules, such as microcapsules or as a solid, particulate carrier combined with the medicine. It is essential that the produced units must be adjustable such that they all contain an essentially equally large quantity of active medical substance.

It is of foremost interest to use such medicines that require strictly individual dosing, where the advantages of the invention will clearly stand out. Further, medicines with a narrow therapeutical window are of interest, i.e. medicines where the interval between an ineffective dose and a dose causing undesirable side effects is particularly narrow. As non-limiting examples of medicines that could become possible choices, morphine and L-dopa can be mentioned.

A device for dosing and dispensing of medicine (could also be named 'automatic dosing machine') should be adjustable in order to deliver a certain number of medicine units or portions or partial doses and may be embodied in different ways. As joint demands that can be made on such a device the following can be mentioned:

a) The device should have the capacity to hold an adequate supply of medicine units (100–10,000 for example) in order not to require too frequent refilling.
b) The device should be reusable with a facility for convenient refilling of medicine units.
c) It should be easy to adjust and to take out the number of medicine units that are required. Here, a mechanical as well as an electronically controlled function are possible choices.
d) An included device for dispensing should be designed in such a manner that the dispensed medicine units are collected in a receptacle, which the patient can use for the ingestion of the medicine.
e) The device must maintain impeccable hygienic conditions. Thus, it must be easy to clean. However, completely aseptic working conditions are not usually required.

In the following disclosure, an example of a device for dosing and dispensing of medicine in accordance with the invention is described in close detail with reference to the accompanying drawings.

Figure 2:
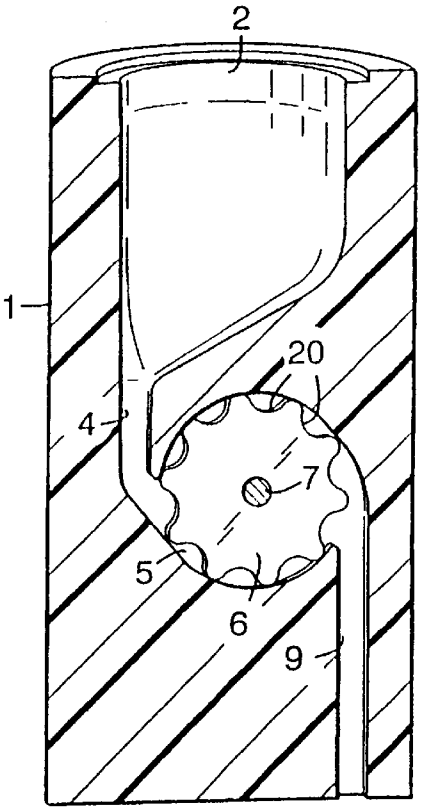
FIGS. 1 and 2, shows schematic views of an embodiment of a device for the carrying out of the procedure in accordance with the invention.
Figure 1:
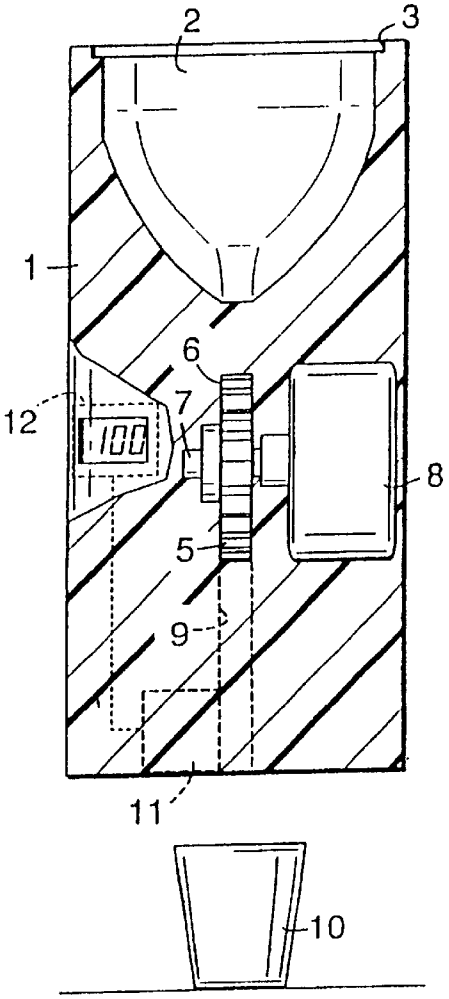

FIG. 1 shows a schematic sectional view of a dosing and dispensing device in accordance with the invention, and FIG. 2 shows a sectional view along the line II—II in FIG. 1. FIG. 3 shows in closer detail the rotating disc or cylinder used for the dosing.

The device comprises a housing (1), in which a storage space (2) for tablets of a medicine is taken up. Through a connection (3), a screw thread for example, the storage space (2) can be connected with a medicine container (not shown) of a standard type, a plastic container for example. At its bottom, the storage space is shaped like a funnel and opens into a slit or channel (4) of such a size that one unit at a time can pass through the channel. In the preferred embodiment of microtablets, the slit should thus be approximately 1.5 mm wide. Furthermore, the storage container can be fitted with devices for the prevention of bridging of the units when they are fed out. This type of devices is well known to the person skilled in the art.

The slit (4) opens into a space (5), in which is placed a rotatable disc or cylinder (6), which through the axis (7) can be brought to rotate by means of the motor (8). The disc (6) is fitted with a number of recesses at its peripheral edge, shown in close detail in FIG. 3. The recesses are each of the size to hold one unit, such as a microtablet. The thickness of the disc (6) and the dimensions of the space (5) are also adjusted in a manner to make this possible.

The space (5) opens into a feeding-out channel (9) for the leading out of the microtablets to a collecting container (10), which for example may consist of a medicine cup of the conventional type, from which the patient can ingest the dispensed medicine dose.

During their transport to the collecting container (10) the microtablets pass a sensor (11), which for example could consist of a photodetector. The sensor (11) will receive an impulse from each microtablet passing it and is connected to a counter (12), which can be adjusted according to the number of units, such as microtablets, to be included in a dose ready for use. When the required number has passed the sensor (11), the counter (12) will give a signal to the motor (8) which then will be stopped. The adjusted medicine dose then has been fed out into the collecting container (10). After the arrangement of a new collecting container (10) and zeroing of the counter (12), the device is ready for dispensing a new dose. By resetting of the counter, another dose, different from the previous one, can easily be set and dispensed.

Another possibility to establish the number of microtablets which have been dispensed is to count the number of revolutions of the motor with the help of a suitable revolution counter. With knowledge of the number of spaces in the disc, it can easily be established how many revolutions the motor makes for the required number of tablets to be dispensed. When this number of revolutions has been attained, the counter will give a signal, as in the previous case, so that the motor is stopped.

Thus, during the dispensing process the microtablets will be transported by the rotation of the disc (6) in an essentially continuous motion and fed out to the dispensing. This transport will be discontinued when the set number of units on the counter has been dispensed and the sensor gives a signal about this.

FIG. 2 shows a sectional view of the device along the line II—II in FIG. 1 seen perpendicularly to the view in FIG. 1. Here the housing (1) is shown with the storage space (2) and the slit or channel (4) at its bottom. It is also clear that the disc (6) with the axis (7) in the space (5) is fitted with recesses (20) for the holding of one microtablet in each recess. The space (5) is dimensioned in a manner to connect the inner wall to the outer diameter of the disc (6) with only a small free space in between. In this mariner a microtablet is securely enclosed in each of the recesses (20) and can not leave the recess during the rotation of the disc, until the recess is positioned in front of the opening of the dispensing channel (9). This opening is situated at a certain peripheral distance from the feeding slit (4) so that the rotating disc (6) with the recesses (20) will function as a feeding-out lock and prevent the feeding-out of more than one microtablet at a time into the dispensing channel.

FIG. 3 shows a plan view of the rotating disc (6) with the axis (7). It is clearly shown that the disc (6) along its periphery is fitted with recesses or dents (20), which preferably are evenly distributed along the periphery of the disc. In the figure the recesses are shown having such a 'soft' design that it gives the periphery of the disc a 'wavy' look, but other designs are also possible. For example, the transits between the recesses and the periphery can be more abrupt to make the disc look more like a cogwheel. A person skilled in the art can establish a suitable design on the basis of simple routine tests. It should be noted that the recesses must not be designed in a manner to risk that the tablets may be crushed between the periphery of the disc (6) and the inner wall of the space (5).

A device in accordance with the invention of the type shown in the figure has turned out to be usable with great advantage for the dosing and dispensing of medicines in the form of small units, such as microtablets. Medicine units in other forms, such as pellets, granules or as microcapsules may require modifications of the device, especially when it comes to the design of the rotating disc or the cylinder (6). Such modifications, however, lies within the competence of a person skilled in the art.

Other embodiments, different in principle, of the device in accordance with the invention are also possible. Thus, the dosing device may be made up of a horizontal disc of the carousel type with evenly distributed, through-going holes close to the periphery. These holes are each dimensioned to hold for example one microtablet or pellet and the disc is arranged to be turned in steps around a vertical axis. When the disc is turned one step, the lower opening of a hole will be uncovered in order to make one unit fall out of this hole down into a collection container. Simultaneously, one unit is filled in from above into another hole of the disc from a storage container. The lower openings of the holes are closed by means of a locking device in all positions except the one from which the unit falls down into the storage container. Thereby the refilled units will gradually be transported to the position from which they are dispensed into the collecting container by the step by step turning of the disc. By means of a sensor, the number of steps or turns performed by the disc is determined and the sensor coupled to a counter will give a signal to discontinue the turning when the required number of units have been dispensed.

Irrespective of how the device in accordance with the invention is designed mechanically, it is in the preferred embodiment equipped with a counter, which has a presentation window and a keyboard. By means of this, the user can set and read the dose required and then press an 'emptying button', whereupon the required dose automatically will be dispensed in a suitable collecting container. Such a device can also be fitted with an arrangement for readjustment and locking of the set dose, in addition to zeroing of the functions.

The mechanical construction of a dosing device in accordance with the invention is not connected with any difficulties for a person skilled in the art, once this person has grasped the general idea of the invention and the embodiments shown. Nor does the selection of suitable materials for the construction present any difficulties.

Through the present invention, a procedure and a device are supplied which satisfy a long-felt want for rapid and uncomplicated varying and fine-tuning of the dose (the smallest possible effective dose) of a medicine for a patient.

In the present description the invention and its working have been illustrated with reference to specific embodiments and examples. However, it is obvious that these are merely examples and are not intended to limit the scope of the invention. To the person skilled in the art it is evident that several other modifications and variants of the invention are possible within the scope of the present patent claims and that the invention is limited by these solely.

What is claimed is:

1. A procedure for the dosing of a medicine comprising the steps of:

removing from a storage of the medicine a number of equally large units as partial doses which consist of tablets or pellets, each of which contains a determined, equally large quantity of an active medical substance and together making up a predetermined total dose of the active medical substance, and wherein each of the units contains from approximately 20% to approximately 2% by weight of the predetermined total dose;

transporting the removed units to a dispensing area; and discontinuing the transporting when a number of units that corresponds to the predetermined total dose have been removed.

2. A procedure in accordance with claim 1, wherein the units are removed from the storage and transported to the dispensing area by an essentially continuous movement.

3. A procedure in accordance with claim 1, wherein the units from the storage are transferred to spaces each of which contains one unit, after which the spaces are moved to dispensing of the units, and in that the movement is discontinued when the number of units corresponding to the predetermined total dose have been transferred to the spaces and moved to the dispensing area.

4. A device for the dosing of medicines, comprising:

(a) a storage container for a medicine in the form of units, which consist of equally sized tablets, each of which contains a determined, equally large partial dose of an active medical substance, the tablets having a diameter within the interval of 1–13 mm;

(b) a device for removing the medicine units from the storage container and transporting the units to a dispensing device; and (c) a device for counting the removed units and discontinuing the transporting to the dispensing device when the number of the units corresponding to a predetermined, adjustable total dose of the active medical substance has been removed.

5. A device in accordance with claim 4, wherein the device for removing and transporting is arranged to transport the medicine units from the storage container to the dispensing device in an essentially continuous movement.

6. A device in accordance with claim 5, wherein the device for transporting and removing of the medicine comprises a sequence of individual spaces into which successively is placed one unit of the medicine, which subsequently is transported to the dispensing device.

7. A device in accordance with claim 5, wherein the device for transporting and removing the medicine comprises a rotating disc or cylinder by which the medicine units are transported to the dispensing device.

8. A device in accordance with claim 7, wherein the rotating disc or cylinder comprises recesses along its peripheral edge, each of the recesses can take up one unit of the medicine and by the rotation transport the unit to the dispensing device.

9. The device in accordance with claim 4, wherein the tablets have a diameter within the interval of 2–8 mm.

10. The device in accordance with claim 9, wherein the tablets have a diameter within the interval of 2–5 mm.

11. A device for the dosing of medicines, comprising:

a) a storage container for a medicine in the form of units, which consist of equally sized pellets, each of which contains a determined, equally large partial dose of an active medical substance, the pellets having a size within the interval of 1–8 mm;

b) a device for removing the medicine units from the storage container and transporting the units to a dispensing device; and c) a device for counting the removed units and discontinuing the transporting to the dispensing device when the number of the units corresponding to a predetermined, adjustable total dose of the active medical substance has been removed.

12. The device in accordance with claim 11, wherein the pellets have a size within the interval of 1–4 mm.

13. The device in accordance with claim 11, wherein the device for removing and transporting is arranged to transport the medicine units from the storage container to the dispensing device in an essentially continuous movement.

* * * * *